US009817358B2

(12) United States Patent
Abe et al.

(10) Patent No.: US 9,817,358 B2
(45) Date of Patent: Nov. 14, 2017

(54) CLEANING BLADE

(71) Applicants: NOK CORPORATION, Tokyo (JP); SYNZTEC CO., LTD., Tokyo (JP)

(72) Inventors: Miyuki Abe, Kanagawa (JP); Kenji Sasaki, Kanagawa (JP); Syo Kawabata, Kanagawa (JP); Katsumi Abe, Kanagawa (JP); Natsumi Kimura, Kanagawa (JP)

(73) Assignees: NOK CORPORATION, Tokyo (JP); SYNZTEC CO., LTD., Tokyo (JP)

( * ) Notice: Subject to any disclaimer, the term of this patent is extended or adjusted under 35 U.S.C. 154(b) by 0 days.

(21) Appl. No.: 15/105,325

(22) PCT Filed: Nov. 27, 2014

(86) PCT No.: PCT/JP2014/081453
§ 371 (c)(1),
(2) Date: Jun. 16, 2016

(87) PCT Pub. No.: WO2015/093252
PCT Pub. Date: Jun. 25, 2015

(65) Prior Publication Data

US 2016/0327899 A1 Nov. 10, 2016

(30) Foreign Application Priority Data

Dec. 16, 2013 (JP) ..... 2013-259646

(51) Int. Cl.
*G03G 21/00* (2006.01)

(52) U.S. Cl.
CPC ..... *G03G 21/0017* (2013.01); *G03G 2221/0005* (2013.01)

(58) Field of Classification Search
CPC ..... G03G 21/0017; G03G 2221/0005
See application file for complete search history.

(56) References Cited

U.S. PATENT DOCUMENTS

2007/0140762 A1 6/2007 Ueno et al.
2009/0003905 A1 1/2009 Ueno et al.
(Continued)

FOREIGN PATENT DOCUMENTS

JP 57-178262 5/1981
JP 2005-148403 6/2005
(Continued)

OTHER PUBLICATIONS

International Search Report, PCT/JP2014/081453, dated Mar. 24, 2015.

*Primary Examiner* — David M Gray
*Assistant Examiner* — Laura Roth
(74) *Attorney, Agent, or Firm* — Young & Thompson

(57) ABSTRACT

A cleaning blade (1) having an elastic body (11) molded from a rubber base material, and having at least a surface treatment layer (12) on the area of the elastic body (11) that is brought into contact with a body to be contacted, wherein the surface treatment layer (12) is formed by impregnating the surface layer portion of the elastic body (11) with a surface treatment liquid containing an isocyanate compound and an organic solvent and hardening the liquid. The elasticity modulus of the surface treatment layer (12) is 40 MPa or less, the elasticity modulus of the elastic body (11) is 3-20 MPa, and the difference between the elasticity modulus of the surface treatment layer (12) and the elasticity modulus of the elastic body (11) is 1 MPa or more.

6 Claims, 1 Drawing Sheet

(56) References Cited

U.S. PATENT DOCUMENTS

| | | | | |
|---|---|---|---|---|
| 2009/0311017 | A1* | 12/2009 | Ohmori | G03G 21/0017 399/350 |
| 2011/0135361 | A1* | 6/2011 | Kabata | G03G 21/0017 399/350 |
| 2011/0236095 | A1 | 9/2011 | Aoshima | |
| 2014/0064792 | A1* | 3/2014 | Kawamura | G03G 9/0821 399/252 |
| 2014/0233998 | A1* | 8/2014 | Watanabe | G03G 21/0017 399/350 |
| 2015/0227106 | A1* | 8/2015 | Mori | G03G 21/0017 399/350 |

FOREIGN PATENT DOCUMENTS

| | | |
|---|---|---|
| JP | 2007-052062 | 3/2007 |
| JP | 2007-193306 | 8/2007 |
| JP | 2008-268670 | 11/2008 |
| JP | 2009-031773 | 2/2009 |
| JP | 2009-063993 | 3/2009 |
| JP | 2010-152295 | 7/2010 |
| JP | 2010-210879 | 9/2010 |
| JP | 2011-180424 | 9/2011 |
| JP | 2011-203303 | 10/2011 |

* cited by examiner

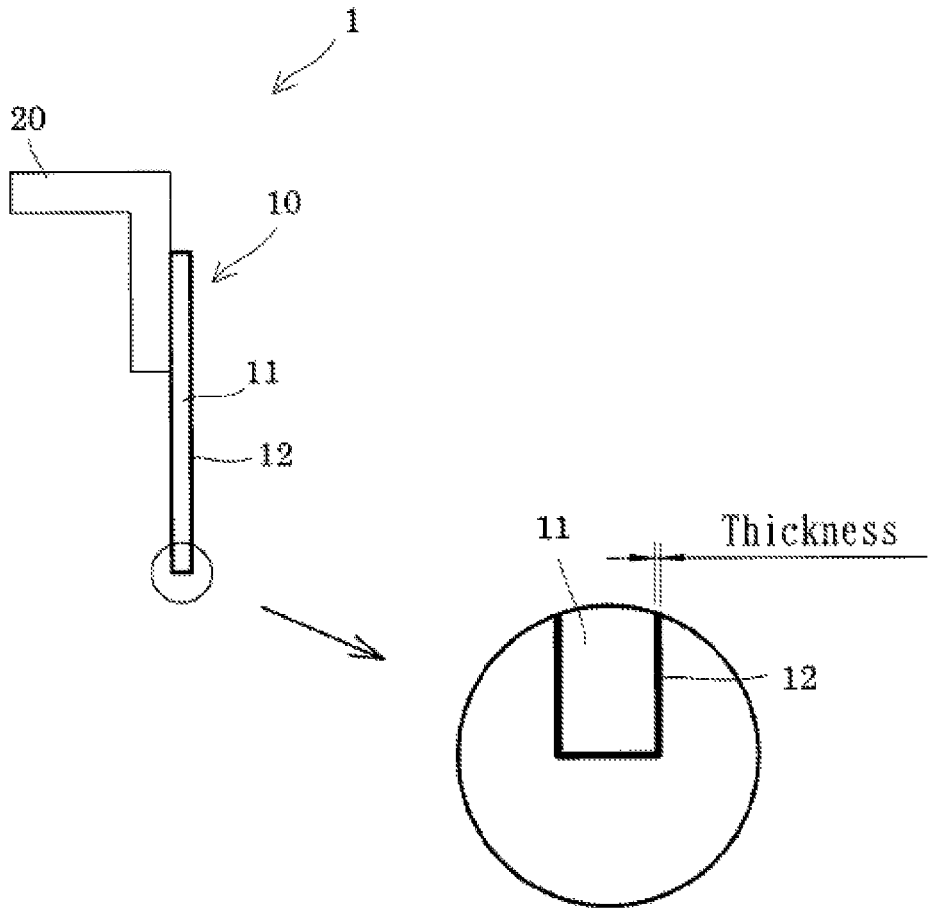
1
20
10
11
12
11
Thickness
12

CLEANING BLADE

TECHNICAL FIELD

The present invention relates to a cleaning blade employed in image-forming apparatuses such as an electrophotographic copying machine or printer, and a toner-jet-type copying machine or printer.

BACKGROUND ART

In a general electrophotographic process, an electrophotographic photoreceptor undergoes processes including at least cleaning, charging, light exposure, development, and image transfer. In each process, the photoreceptor is subjected to treatments by means of, for example, a cleaning blade for removing toner remaining on the surface of a photoreceptor drum, a conductive roller for uniformly imparting electric charge to the photoreceptor, and a transfer belt for transferring a toner image. From the viewpoints of plastic deformation and wear resistance, the cleaning blade is usually produced from a thermosetting polyurethane resin.

However, when a cleaning blade formed of polyurethane resin is used, the friction coefficient between a blade member and a photoreceptor drum increases, whereby defoliation of the blade or generation of anomalous sounds occurs. In such a case, the drive torque of the photoreceptor drum must be increased. In addition, in some cases, the edge of a cleaning blade is adhered to a photoreceptor drum or the like, resulting in drawing and cutting, whereby the edge of the cleaning blade may be damaged through wearing.

In order to solve such problems, efforts have been made for providing a contact part of the polyurethane blade with higher hardness and lower friction. In one proposed method, a polyurethane-made blade is impregnated with an isocyanate compound, to thereby cause reaction between the polyurethane resin and the isocyanate compound, whereby the hardness of the surface the polyurethane resin blade and a portion in the vicinity the surface of the blade are selectively increased, and their friction is reduced (see, for example, Patent Document 1).

However, when the surface of the blade is enhanced, chipping of the blade problematically occurs. Also, although reducing the friction of the blade surface can prevent occurrence of filming (i.e., a phenomenon of toner adhering onto a photoreceptor drum), undesired release of toner tends to occur, problematically resulting in cleaning failure.

Another proposed cleaning blade has specific properties including dynamic hardness and friction coefficient of the polyurethane resin blade surface (see, for example, Patent Documents 2 to 5). However, even though properties including dynamic hardness and friction coefficient of the polyurethane resin blade surface are limited, a satisfactory blade has not been always realized, and generation of chipping and filming after long-term use cannot be satisfactorily suppressed.

PRIOR ART DOCUMENTS

Patent Documents

Patent Document 1: Japanese Patent Application Laid-Open (kokai) No. 2007-52062

Patent Document 2: Japanese Patent Application Laid-Open (kokai) No. 2010-152295

Patent Document 3: Japanese Patent Application Laid-Open (kokai) No. 2010-210879

Patent Document 4: Japanese Patent Application Laid-Open (kokai) No. 2009-63993

Patent Document 5: Japanese Patent Application Laid-Open (kokai) No. 2011-180424

SUMMARY OF THE INVENTION

Problems to be Solved by the Invention

In view of the foregoing, an object of the present invention is to provide a cleaning blade which has excellent chipping resistance and which realizes suppression of filming and enhancement of cleaning performance.

Means for Solving the Problems

In one mode of the present invention for solving the aforementioned problems, there is provided a cleaning blade, having an elastic body formed of a rubber base material molded product, and a surface treatment layer on at least an area of the elastic body to be brought into contact with a cleaning object, characterized in that:

the surface treatment layer is formed by impregnating a surface portion of the elastic body with a surface treatment liquid containing an isocyanate compound and an organic solvent, and hardening the liquid;

the surface treatment layer has an indentation elastic modulus of 40 MPa or lower;

the elastic body has an indentation elastic modulus of 3 MPa to 20 MPa; and the difference in indentation elastic modulus between the surface treatment layer and the elastic body is 1 MPa or more.

According to the present invention, there can be realized a cleaning blade which has excellent chipping resistance and which realizes suppression of filming and enhancement of cleaning performance.

The surface treatment layer preferably has a thickness of 10 μm to 50 μm.

Through controlling the thickness, the surface treatment layer has a small thickness. Thus, even when the surface treatment layer has an indentation elastic modulus greater than that of the elastic body, the surface treatment layer can follow deformation of the elastic body, whereby chipping resistance of the cleaning blade can be further enhanced.

Effects of the Invention

The present invention realizes a cleaning blade which has excellent chipping resistance and which realizes suppression of filming and enhancement of cleaning performance. Also, through controlling the thickness of the surface treatment layer to 10 μm to 50 μm, excellent chipping resistance, suppression of filming, and enhancement in cleaning performance can be all ensured.

BRIEF DESCRIPTION OF THE DRAWINGS

The Figure shows cross-section of an example of the cleaning blade according to the present invention.

MODES FOR CARRYING OUT THE INVENTION

The cleaning blade of the present invention for use in an image-forming device will next be described in detail.

Embodiment 1

As shown in the Figure, a cleaning blade 1 has a blade main body (also referred to as "cleaning blade") 10, and a supporting member 20. The blade main body 10 is joined to the supporting member 20 by means of an adhesive (not illustrated). The blade main body 10 is formed of an elastic body 11, which is a molded product of a rubber base material. The elastic body 11 has a surface treatment layer 12 formed at a surface portion thereof. The surface treatment layer 12 is formed by impregnating the surface portion of the elastic body 11 with the surface treatment liquid and hardening the liquid. The surface treatment layer 12 may be formed on at least an area of the elastic body 11 to be brought into contact with a cleaning object. In Embodiment 1, the surface treatment layer 12 is formed on the entire surface of the elastic body 11 so as to serve as the surface portion.

As shown in FIG. 1, a cleaning blade 1 has a blade main body (also referred to as "cleaning blade") 10, and a supporting member 20. The blade main body 10 is joined to the supporting member 20 by means of an adhesive (not illustrated). The blade main body 10 is formed of an elastic body 11, which is a molded product of a rubber base material. The elastic body 11 has a surface treatment layer 12 formed at a surface portion thereof. The surface treatment layer 12 is formed by impregnating the surface portion of the elastic body 11 with the surface treatment liquid and hardening the liquid. The surface treatment layer 12 may be formed on at least an area of the elastic body 11 to be brought into contact with a cleaning object. In Embodiment 1, the surface treatment layer 12 is formed on the entire surface of the elastic body 11 so as to serve as the surface portion.

The surface treatment layer 12 has an indentation elastic modulus (i.e., a type of bulk modulus; hereinafter may be referred to simply as "elastic modulus") of 40 MPa or lower. When the elastic modulus of the surface treatment layer 12 is adjusted to exceed 40 MPa, the surface treatment layer 12 cannot follow deformation of the elastic body 11, resulting in chipping of the surface treatment layer 12.

The elastic modulus of the elastic body 11 is 3 MPa to 20 MPa. When the elastic modulus of the elastic body 11 is adjusted to be lower than 3 MPa, the cleaning target (i.e., a contact target), which is a photoreceptor drum in Embodiment 1, receives elevated torque, thereby reducing the filming suppression effect. In contrast, the indentation elastic modulus of the elastic body 11 is adjusted to exceed 20 MPa, sufficient adhesion between the photoreceptor drum and the cleaning blade fails to be attained.

The difference in elastic modulus between the surface treatment layer 12 and the elastic body 11 is 1 MPa or more. When the difference in elastic modulus between the surface treatment layer 12 and the elastic body 11 is smaller than 1 MPa, sufficient filming suppression effect fails to be attained.

As described above, the elastic modulus of the surface treatment layer 12 is 40 MPa or lower; the elastic modulus of the elastic body 11 is 3 MPa to 20 MPa, and the difference in elastic modulus between the surface treatment layer 12 and the elastic body 11 is 1 MPa or more. Although the details will be described below, under the above conditions, the cleaning blade 1 realizes all of excellent chipping resistance, suppression of filming, and enhancement in cleaning performance.

Furthermore, the surface treatment layer 12 is preferably formed at a surface portion of the elastic body 11 so as to have a very small thickness; specifically, 10 μm to 50 μm. Such a thickness is very small and about 1/10 the thickness of a conventional surface treatment layer 12. However, as mentioned above, even when the elastic modulus of the surface treatment layer increases, the layer can follow deformation of the elastic body 11, thereby providing excellent chipping resistance.

The surface treatment layer 12 preferably has a dynamic friction coefficient of 1.0 to 2.5. When the dynamic friction coefficient is adjusted to be smaller than 1.0, undesired release of toner occurs, thereby causing cleaning failure. In contrast, when the dynamic friction coefficient is adjusted to exceed 2.5, the torque applied to the photoreceptor drum rises, resulting in toner cohesion on the photoreceptor. In this case, when aggregated toner is pressed by the blade, the toner adheres on the photoreceptor drum, thereby causing filming. Therefore, through controlling the dynamic friction coefficient to fall within a range of 1.0 to 2.5, torque is lowered, to thereby suppress filming and cleaning failure.

Thus, excellent chipping resistance, suppression of filming, and enhancement in cleaning performance can be all ensured, through controlling, to fall within specific ranges, the elastic modulus of the surface treatment layer 12, the elastic modulus of the elastic body 11, the difference in elastic modulus therebetween, the thickness of the surface treatment layer 12, and the dynamic friction coefficient.

The surface treatment layer 12 having a very small thickness can be formed at a surface portion of the elastic body 11 by use of a surface treatment liquid having high affinity to the elastic body 11. By use of such a surface treatment liquid, the elastic body 11 can be readily impregnated with the surface treatment liquid, whereby residence of an excess amount of surface treatment liquid on the surface of elastic body 11 can be prevented. Thus, a removal step of removing an excessive isocyanate compound can be omitted.

The surface treatment liquid for forming the surface treatment layer 12 contains an isocyanate compound and an organic solvent. Examples of the isocyanate compound contained in the surface treatment liquid include tolylene diisocyanate (TDI), 4,4'-diphenylmethane diisocyanate (MDI), p-phenylene diisocyanate (PPDI), naphthylene diisocyanate (NDI), and 3,3'-dimethylbiphenyl-4,4'-diyl diisocyanate (TODI), and oligomers and modified products thereof.

As the surface treatment liquid, there is preferably used a mixture of an isocyanate compound, a polyol, and an organic solvent, or a mixture of a prepolymer having isocyanate groups and an organic solvent. The prepolymer is an isocyanate-group-containing compound which is produced by reacting an isocyanate compound with a polyol and which has an isocyanate group at an end thereof. Among such surface treatment liquids, more preferred surface treatment liquids are a mixture of a bi-functional isocyanate compound, a tri-functional polyol, and an organic solvent; and a mixture of an organic solvent and an isocyanate-group-containing prepolymer obtained through reaction between a bi-functional isocyanate compound and a tri-functional polyol. In the case where a mixture of a bi-functional isocyanate compound, a tri-functional polyol, and an organic solvent is used, the bi-functional isocyanate compound reacts with the tri-functional polyol in the step of impregnating the surface portion with the surface treatment liquid and hardening the liquid, whereby an isocyanate-group-containing prepolymer having an isocyanate group at an end thereof is produced. The prepolymer is hardened and reacts with the elastic body 11.

Thus, by use of a surface treatment liquid which allows formation of an isocyanate-group-containing prepolymer via reaction between a bi-functional isocyanate compound and a tri-functional polyol, or a surface treatment liquid containing an isocyanate-group-containing prepolymer, the formed surface treatment layer 12 exhibits high hardness and low friction, even though it is a thin layer. As a result, chipping resistance, suppression of filming, and excellent cleaning performance can be attained. Notably, the surface treatment liquid is appropriately selected in consideration of wettability to the elastic body 11, the degree of immersion, and the pot life of the surface treatment liquid.

Examples of the bi-functional isocyanate compound include 4,4'-diphenylmethane diisocyanate (MDI), isophorone diisocyanate (IPDI), 4,4'-dicyclohexylmethane diisocyanate (H-MDI), trimethylhexamethylene diisocyanate (TMHDI), tolylene diisocyanate (TDI), carbodiimide-modified MDI, polymethylene polyphenyl polyisocyanate, 3,3'-dimethylbiphenyl-4,4'-diyl diisocyanate (TODI), naphthylene diisocyanate (NDI), xylene diisocyanate (XDI), lysine diisocyanate methyl ester (LDI), dimethyl diisocyanate, and oligomers and modified products thereof. Among bi-functional isocyanate compounds, those having a molecular weight of 200 to 300 are preferably used. Among the above isocyanate compounds, 4,4'-diphenylmethane diisocyanate (MDI) and 3,3'-dimethylbiphenyl-4,4'-diyl diisocyanate (TODI) are preferred. Particularly when the elastic body 11 is formed of polyurethane, the bi-functional isocyanate compound has high affinity to polyurethane, whereby integration of the surface treatment layer 12 and the elastic body 11 via chemical bonding can be further enhanced.

Examples of the tri-functional polyol include tri-hydric aliphatic polyols such as glycerin, 1,2,4-butanetriol, trimethylolethane (TME), trimethylolpropane (TMP), and 1,2,6-hexanetriol; polyether triols formed through addition of ethylene oxide, butylene oxide, or the like to tri-hydric aliphatic polyols; and polyester triols formed through addition of a lactone or the like to tri-hydric aliphatic polyols. Among tri-hydric aliphatic polyols, those having a molecular weight of 150 or lower are preferably used. Among the above tri-functional polyols, trimethylolpropane (TMP) is preferably used. When a tri-functional polyol having a molecular weight of 150 or lower is used, reaction with isocyanate proceeds at high reaction rate, whereby a surface treatment layer with high hardness can be formed. Also, when a surface treatment liquid containing a tri-hydric polyol is used, three hydroxyl groups react with isocyanate groups, to thereby yield the surface treatment layer 12 having high cross-link density attributed to a 3-dimensional structure.

No particular limitation is imposed on the organic solvent, so long as it can dissolve an isocyanate compound and a polyol, and a solvent having no active hydrogen which reacts with the isocyanate compound is suitably used. Examples of the organic solvent include methyl ethyl ketone (MEK), methyl isobutyl ketone (MIBK), tetrahydrofuran (THF), acetone, ethyl acetate, butyl acetate, toluene, and xylene. The lower the boiling point of the organic solvent, the higher the solubility. By use of a low-boiling-temperature solvent, drying after impregnation can be completed rapidly, thereby attaining uniform treatment. Notably, the organic solvent is chosen from these organic solvents in consideration of the degree of swelling of the elastic body 11. From this viewpoint, methyl ethyl ketone (MEK), acetone, and ethyl acetate are preferably used.

The elastic body 11 is formed of a matrix having active hydrogen. Examples of the rubber base material forming the matrix having active hydrogen include polyurethane, epichlorohydrin rubber, nitrile rubber (NBR), styrene rubber (SBR), chloroprene rubber, and ethylene-propylene-diene rubber (EPDM). Of these, polyurethane is preferred, in view of reactivity to the isocyanate compound.

Examples of the rubber base material formed of polyurethane include those mainly comprising at least one species selected from among aliphatic polyethers, polyesters, and polycarbonates. More specifically, such a rubber base material is mainly formed of a polyol containing at least one species selected from among aliphatic polyethers, polyesters, and polycarbonates, the polyol molecules are bonded via urethane bond. Examples of preferred polyurethanes include polyether-based polyurethane, polyester-based polyurethane, and polycarbonate-based polyurethane. Alternatively, a similar elastic body employing polyamide bond, ester bond, or the like, instead of urethane bond, may also be used. Yet alternatively, a thermoplastic elastomer such as polyether-amide or polyether-ester may also be used. Also, in addition to, or instead of a rubber base material having active hydrogen, a filler or a plasticizer having active hydrogen may be used.

The surface portion of the elastic body 11 is impregnated with the surface treatment liquid, and the liquid is hardened, to thereby form the surface treatment layer 12 at the surface portion of the elastic body 11. No particular limitation is imposed on the method of impregnating the surface portion of the elastic body 11 with the surface treatment liquid and hardening the liquid. In one specific procedure, the elastic body 11 is immersed in the surface treatment liquid, and then the elastic body is heated. In another procedure, the surface treatment liquid is sprayed onto the surface of the elastic body 11 for impregnation, and then the elastic body is heated. No particular limitation is imposed on the heating method, and examples include heating, forced drying, and natural drying.

More specifically, when a mixture of an isocyanate compound, a polyol, and an organic solvent is used as a surface treatment liquid, the surface treatment layer 12 is formed via reaction of the isocyanate compound with the polyol, to form a prepolymer concomitant with hardening, during impregnation of the surface portion of the elastic body 11 with the surface treatment liquid, and reaction of isocyanate groups with the elastic body 11.

In the case where a prepolymer is used as a surface treatment liquid, the isocyanate compound and the polyol present in the surface treatment liquid are caused to react in advance under specific conditions, to thereby convert the surface treatment liquid to a prepolymer having an isocyanate group at an end thereof. The surface treatment layer 12 is formed via impregnation of the surface portion of the elastic body 11 with the surface treatment liquid, and post hardening and reaction of isocyanate groups with the elastic body 11. Formation of the prepolymer from the isocyanate compound and the polyol may occur during impregnation of the surface portion of the elastic body 11 with the surface treatment liquid, and the extent of reaction may be controlled by regulating reaction temperature, reaction time, and the atmosphere of the reaction mixture. Preferably, the formation is performed at a surface treatment liquid temperature of 5° C. to 35° C. and a humidity of 20% to 70%. Notably, the surface treatment liquid may further contain a cross-linking agent, a catalyst, a hardening agent, etc., in accordance with needs.

The surface treatment layer 12 is formed on at least an area of the elastic body 11 to be brought into contact with a cleaning object. That is, the surface treatment layer 12 may be formed on a front end area of the elastic body 11, or on the entire surface of the elastic body. Alternatively, after fabrication of a cleaning blade by bonding the elastic body 11 to the supporting member 20, the surface treatment layer 12 may be formed on a front end area of the elastic body 11, or on the entire surface of the elastic body. Yet alternatively, the surface treatment layer 12 may be formed on one or both surfaces and the entire surface of a rubber molded product, from which the elastic body 11 in a blade shape is cut, followed by cutting the rubber molded product.

According to the present invention, through controlling the elastic modulus of the surface treatment layer 12, the elastic modulus of the elastic body 11, and the difference in elastic modulus therebetween to fall within specific ranges, there can be provided a cleaning blade which has excellent chipping resistance and realizes suppression of filming and enhancement in cleaning performance. In addition, through controlling the thickness and dynamic friction coefficient of the surface treatment layer, excellent chipping resistance, suppression of filming, and enhancement in cleaning performance can be ensured.

EXAMPLES

The present invention will next be described in detail by way of Examples, which should not be construed as limiting the invention thereto.

Firstly, cleaning blades of Examples 1 to 11 and Comparative Examples 1 to 8 were prepared. These cleaning blades differ in the elastic modulus values of their surface treatment layers, elastic modulus values of their elastic bodies (hereinafter referred to as rubber elastic bodies), or differ in elastic modulus therebetween.

Example 1

Production of Rubber Elastic Body

A caprolactone-based polyol (molecular weight: 2,000) (100 parts by mass) serving as the polyol, and 4,4'-diphenylmethane diisocyanate (MDI) (38 parts by mass) serving as the isocyanate compound were allowed to react at 115° C. for 20 minutes. Subsequently, 1,4-butanediol (6.1 parts by mass) and trimethylolpropane (2.6 parts by mass), serving as cross-linking agents, were added thereto, and the mixture was transferred to a metal mold maintained at 140° C. and heated for hardening for 40 minutes. Then, the product was centrifuged, and cut to pieces of the rubber elastic body having dimensions of 15.0 mm in width, 2.0 mm in thickness, and 350 mm in length. The thus-obtained rubber elastic body pieces were found to have an elastic modulus of 9.8 MPa.

Preparation of Surface Treatment Liquid

MDI (product of Nippon Polyurethane Industry Co., Ltd., molecular weight: 250.25) (7.7 parts by mass), TMP (product of Nippon Polyurethane Industry Co., Ltd., molecular weight: 134.17) (2.3 parts by mass), and MEK (90 parts by mass) were mixed together, to thereby prepare a surface treatment liquid having a concentration of 10%.

Surface Treatment of Rubber Elastic Body

While the surface treatment liquid was maintained at 23° C., the rubber elastic body was immersed in the surface treatment liquid for 10 seconds. The thus-treated rubber elastic body was heated for one hour in an oven maintained at 50° C. Thereafter, the surface-treated rubber elastic body was attached to a supporting member, to thereby fabricate a cleaning blade. The thus-obtained cleaning blade had a surface treatment layer having an elastic modulus of 11.4 MPa and a thickness of 30 μm, and exhibited a difference in elastic modulus between the surface treatment layer and the rubber elastic body of 1.6 MPa, and a dynamic friction coefficient of the surface treatment layer of 1.3.

The elastic modulus of the surface treatment layer and that of the rubber elastic body were indentation elastic modulus values as determined according to ISO 14577. The indentation elastic modulus was measured through a load-unload test by means of Dynamic Ultra Micro Hardness Tester DUH-201 (product of Shimadzu Corporation) under the following conditions: retention time (5 s), maximum test load (0.98 N), loading speed (0.14 mN/s), and indentation depth (3 μm to 10 μm). Each measurement sample was cut from the same rubber sheet as that which provided the corresponding cleaning blade. The indentation elastic modulus of the surface treatment layer was determined through the following procedure. Specifically, a test piece (40 mm×12 mm) was cut from a central part of the rubber elastic body having a surface treatment layer, and affixed on a glass slide with double-sided tape such that the mirror surface (i.e., the surface opposite the mold-contact surface upon centrifugal molding) faced upwardly. The thus-affixed test piece was allowed to stand in a thermostat bath controlled at 23° C. for 30 to 40 minutes. Elastic modulus was measured at a position 30 μm apart from the edge line (i.e., a longitudinal side of the sample) and at the center along the longitudinal direction of the measurement sample. The same measurement was successively performed at a position 60 μm apart from the edge line, a position 90 μm apart from the edge line, and the like. The measurement was performed at 20 positions in total, and 20 measurements were averaged. The indentation elastic modulus of the rubber elastic body was measured by use of a sample cut from the corresponding rubber elastic body before formation of the surface treatment layer.

The thickness of the surface treatment layer was measured by means of Dynamic Ultra Micro Hardness Tester (product of Shimadzu Corporation) according to JIS 22255 and ISO 14577. Specifically, the surface hardness of the rubber elastic body was measured, and then the elastic body was subjected to the surface treatment. The rubber elastic body was cut, and the hardness profile from the cut surface to the inside of the rubber elastic body was measured. The length along the depth direction where the change in hardness was 30% or lower with respect to the hardness at a depth from the cut surface of 10 μm was determined. The length from the cut surface was employed as the thickness of the surface treatment layer.

The dynamic friction coefficient of the surface treatment layer was determined by means of a surface tester (product of Shinto Scientific Co., Ltd.) according to JIS K7125 and P8147, and ISO 8295. A SUS304 steel ball (diameter: 10 mm) was used as a counter member. Measurement conditions included a moving speed of 50 mm/min, a load of 0.49 N, and an amplitude of 50 mm.

Example 2

The procedure of Example 1 was repeated, except that MDI (55 parts by mass) was used, to thereby form a rubber elastic body. The thus-obtained rubber elastic body was found to have an elastic modulus of 15.4 MPa. The rubber elastic body was subjected to the same surface treatment as performed in Example 1, to thereby produce a cleaning blade having a surface treatment layer with an elastic modulus of 18.5 MPa and a thickness of 30 μm. The cleaning blade was found to have a difference in elastic modulus between the surface treatment layer and the rubber elastic body of 3.1 MPa, and the surface treatment layer was found to have a dynamic friction coefficient of 1.1.

Example 3

The procedure of Example 1 was repeated, to thereby form a rubber elastic body. The thus-obtained rubber elastic body was found to have an elastic modulus of 9.8 MPa. The rubber elastic body was subjected to a surface treatment in a manner similar to that of Example 1, except that a surface treatment liquid (concentration: 12.5%) containing MDI (9.6 parts by mass), TMP (2.9 parts by mass), and MEK (87.5 parts by mass) was used, to thereby produce a cleaning blade having a surface treatment layer with an elastic modulus of 18.8 MPa and a thickness of 30 μm. The cleaning blade was found to have a difference in elastic modulus between the surface treatment layer and the rubber elastic body of 9.0 MPa, and the surface treatment layer was found to have a dynamic friction coefficient of 1.2.

Example 4

The procedure of Example 1 was repeated, to thereby form a rubber elastic body. The thus-obtained rubber elastic body was found to have an elastic modulus of 9.8 MPa. The rubber elastic body was subjected to a surface treatment in a manner similar to that of Example 1, except that a surface treatment liquid (concentration: 15%) containing MDI (11.5 parts by mass), TMP (3.5 parts by mass), and MEK (85 parts by mass) was used, to thereby produce a cleaning blade having a surface treatment layer with an elastic modulus of 28.5 MPa and a thickness of 30 μm. The cleaning blade was found to have a difference in elastic modulus between the surface treatment layer and the rubber elastic body of 18.7 MPa, and the surface treatment layer was found to have a dynamic friction coefficient of 1.1.

Example 5

The procedure of Example 1 was repeated, except that MDI (34 parts by mass) was used, to thereby form a rubber elastic body. The thus-obtained rubber elastic body was found to have an elastic modulus of 4.8 MPa. The rubber elastic body was subjected to a surface treatment in a manner similar to that of Example 1, except that a surface treatment liquid (concentration: 20%) containing MDI (15.4 parts by mass), TMP (4.6 parts by mass), and MEK (80 parts by mass) was used, to thereby produce a cleaning blade having a surface treatment layer with an elastic modulus of 23.1 MPa and a thickness of 30 μm. The cleaning blade was found to have a difference in elastic modulus between the surface treatment layer and the rubber elastic body of 18.3 MPa, and the surface treatment layer was found to have a dynamic friction coefficient of 1.1.

Example 6

The procedure of Example 1 was repeated, to thereby form a rubber elastic body. The thus-obtained rubber elastic body was found to have an elastic modulus of 9.8 MPa. The rubber elastic body was subjected to surface treatment with the same surface treatment liquid as employed in Example 5, to thereby produce a cleaning blade having a surface treatment layer with an elastic modulus of 23.9 MPa and a thickness of 30 μm. The cleaning blade was found to have a difference in elastic modulus between the surface treatment layer and the rubber elastic body of 14.1 MPa, and the surface treatment layer was found to have a dynamic friction coefficient of 1.3.

Example 7

The procedure of Example 1 was repeated, except that MDI (52 parts by mass) was used, to thereby form a rubber elastic body. The thus-obtained rubber elastic body was found to have an elastic modulus of 14.3 MPa. The rubber elastic body was subjected to the same surface treatment as performed in Example 1, to thereby produce a cleaning blade having a surface treatment layer with an elastic modulus of 16.3 MPa and a thickness of 30 μm. The cleaning blade was found to have a difference in elastic modulus between the surface treatment layer and the rubber elastic body of 2.0 MPa, and the surface treatment layer was found to have a dynamic friction coefficient of 1.4.

Example 8

The procedure of Example 5 was repeated, to thereby form a rubber elastic body. The rubber elastic body was subjected to the same surface treatment as performed in Example 3, to thereby produce a cleaning blade having a surface treatment layer with an elastic modulus of 8.7 MPa and a thickness of 30 μm. The cleaning blade was found to have a difference in elastic modulus between the surface treatment layer and the rubber elastic body of 3.9 MPa, and the surface treatment layer was found to have a dynamic friction coefficient of 1.2.

Example 9

The procedure of Example 7 was repeated, to thereby form a rubber elastic body. The thus-obtained rubber elastic body was found to have an elastic modulus of 14.3 MPa. The rubber elastic body was subjected to a surface treatment in a manner similar to that of Example 5, except that a surface treatment liquid (concentration: 7.5%) containing MDI (5.7 parts by mass), TMP (1.8 parts by mass), and MEK (92.5 parts by mass) was used, to thereby produce a cleaning blade having a surface treatment layer with an elastic modulus of 15.6 MPa and a thickness of 30 μm. The cleaning blade was found to have a difference in elastic modulus between the surface treatment layer and the rubber elastic body of 1.3 MPa, and the surface treatment layer was found to have a dynamic friction coefficient of 1.6.

Example 10

The procedure of Example 1 was repeated, to thereby form a rubber elastic body. The thus-obtained rubber elastic body was found to have an elastic modulus of 9.8 MPa. The rubber elastic body was subjected to a surface treatment in a manner similar to that of Example 1, except that a surface treatment liquid (concentration: 5%) containing MDI (3.8 parts by mass), TMP (1.3 parts by mass), and MEK (95 parts by mass) was used, to thereby produce a cleaning blade having a surface treatment layer with an elastic modulus of 10.9 MPa and a thickness of 30 μm. The cleaning blade was found to have a difference in elastic modulus between the surface treatment layer and the rubber elastic body of 1.1 MPa, and the surface treatment layer was found to have a dynamic friction coefficient of 1.8.

Example 11

The procedure of Example 7 was repeated, to thereby form a rubber elastic body. The thus-obtained rubber elastic body was found to have an elastic modulus of 14.3 MPa. The rubber elastic body was subjected to surface treatment with the same surface treatment liquid as employed in Example 1, to thereby produce a cleaning blade having a surface treatment layer with an elastic modulus of 15.3 MPa and a thickness of 30 μm. The cleaning blade was found to have a difference in elastic modulus between the surface treatment layer and the rubber elastic body of 1.0 MPa, and the surface treatment layer was found to have a dynamic friction coefficient of 1.6.

Comparative Example 1

The procedure of Example 1 was repeated, to thereby form a rubber elastic body. The thus-obtained rubber elastic body was found to have an elastic modulus of 9.8 MPa. The rubber elastic body was subjected to a surface treatment in a manner similar to that of Example 1, except that a surface treatment liquid (concentration: 17.5%) containing MDI (13.5 parts by mass), TMP (4.0 parts by mass), and MEK (82.5 parts by mass) was used, to thereby produce a cleaning blade having a surface treatment layer with an elastic modulus of 40.2 MPa and a thickness of 30 μm. The cleaning blade was found to have a difference in elastic modulus between the surface treatment layer and the rubber elastic body of 30.4 MPa, and the surface treatment layer was found to have a dynamic friction coefficient of 1.0.

Comparative Example 2

The procedure of Example 1 was repeated, to thereby form a rubber elastic body. The thus-obtained rubber elastic body was found to have an elastic modulus of 9.8 MPa. The rubber elastic body was subjected to surface treatment in the same manner as employed in Example 5, to thereby produce a cleaning blade having a surface treatment layer with an elastic modulus of 43.1 MPa and a thickness of 30 μm. The cleaning blade was found to have a difference in elastic modulus between the surface treatment layer and the rubber elastic body of 33.3 MPa, and the surface treatment layer was found to have a dynamic friction coefficient of 1.0.

Comparative Example 3

The procedure of Example 1 was repeated, except that MDI (30 parts by mass) was used, to thereby form a rubber elastic body. The thus-obtained rubber elastic body was found to have an elastic modulus of 2.8 MPa. The rubber elastic body was subjected to surface treatment in a manner similar to that of Example 1, except that a surface treatment liquid (concentration: 30%) containing MDI (23.1 parts by mass), TMP (6.9 parts by mass), and MEK (70 parts by mass) was used, to thereby produce a cleaning blade having a surface treatment layer with an elastic modulus of 22.6 MPa and a thickness of 30 μm. The cleaning blade was found to have a difference in elastic modulus between the surface treatment layer and the rubber elastic body of 19.8 MPa, and the surface treatment layer was found to have a dynamic friction coefficient of 0.8.

Comparative Example 4

The procedure of Comparative Example 3 was repeated, to thereby form a rubber elastic body. The thus-obtained rubber elastic body was found to have an elastic modulus of 2.8 MPa. The rubber elastic body was subjected to surface treatment in the same manner as employed in Comparative Example 1, to thereby produce a cleaning blade having a surface treatment layer with an elastic modulus of 14.5 MPa and a thickness of 30 μm. The cleaning blade was found to have a difference in elastic modulus between the surface treatment layer and the rubber elastic body of 11.7 MPa, and the surface treatment layer was found to have a dynamic friction coefficient of 0.9.

Comparative Example 5

The procedure of Example 1 was repeated, to thereby form a rubber elastic body. The thus-obtained rubber elastic body was found to have an elastic modulus of 9.8 MPa. The rubber elastic body was subjected to no surface treatment, to thereby produce a cleaning blade having a surface dynamic friction coefficient 3.3. In Table 1, the elastic modulus of the surface treatment layer is an elastic modulus of the rubber elastic body. The same is applied in Comparative Example 6 below.

Comparative Example 6

The procedure of Example 7 was repeated, to thereby form a rubber elastic body. The thus-obtained rubber elastic body was found to have an elastic modulus of 14.3 MPa. The rubber elastic body was subjected to no surface treatment, to thereby produce a cleaning blade having a surface dynamic friction coefficient 3.3.

Comparative Example 7

The procedure of Example 7 was repeated, to thereby form a rubber elastic body. The thus-obtained rubber elastic body was found to have an elastic modulus of 14.3 MPa. The rubber elastic body was subjected to surface treatment in the same manner as employed in Example 10, to thereby produce a cleaning blade having a surface treatment layer with an elastic modulus of 14.9 MPa and a thickness of 30 μm. The cleaning blade was found to have a difference in elastic modulus between the surface treatment layer and the rubber elastic body of 0.6 MPa, and the surface treatment layer was found to have a dynamic friction coefficient of 2.6.

Comparative Example 8

The procedure of Example 1 was repeated, to thereby form a rubber elastic body. The thus-obtained rubber elastic body was found to have an elastic modulus of 9.8 MPa. The rubber elastic body was subjected to a surface treatment in a manner similar to that of Example 1, except that a surface treatment liquid (concentration: 2.5%) containing MDI (1.9 parts by mass), TMP (0.6 parts by mass), and MEK (97.5 parts by mass) was used, to thereby produce a cleaning blade having a surface treatment layer with an elastic modulus of 10.7 MPa and a thickness of 30 μm. The cleaning blade was found to have a difference in elastic modulus between the surface treatment layer and the rubber elastic body of 0.9 MPa, and the surface treatment layer was found to have a dynamic friction coefficient of 2.8.

Test Example 1

<Surface Treatment Layer, Elastic Modulus of Rubber Elastic Body, and Difference in Elastic Modulus>

Each of the cleaning blades produced in the Examples 1 to 11 and Comparative Examples 1 to 8 was evaluated in terms of chipping resistance, filming suppression, and cleaning performance. The above evaluation was performed by means of an apparatus TASKalfa5550ci (product of KYOCERA Corporation).

Chipping resistance was evaluated by setting the cleaning blade in a cartridge, and carrying out printing for 100,000 sheets. After the printing job, in the case where no chipping or wearing or chipping was observed, the state was evaluated as "○." When slight chipping or wear was observed, the state was evaluated as "Δ." When any chipping or wear was observed, the state was evaluated as "X."

Filming suppression was also evaluated, by setting the cleaning blade in a cartridge, and carrying out printing for 100,000 sheets. After the printing job, in the case where no toner adhesion was observed, the state was evaluated as "○." When slight toner adhesion was observed, the state was evaluated as "Δ." When toner adhesion was observed, the state was evaluated as "X."

Cleaning performance was also evaluated, by setting the cleaning blade in a cartridge, and carrying out printing for 100,000 sheets. After the printing job, in the case where no toner remaining was observed, the state was evaluated as "○." When slight toner remaining was observed, the state was evaluated as "Δ." When any toner remaining was observed, the state was evaluated as "X." Table 1 shows the results.

With reference to in Table 1, comparisons were made for Examples 1 to 11 with Comparative Examples 1 to 8. As shown in Table 1, the cleaning blades of Examples 1 to 11 exhibited an elastic modulus of the surface treatment layer of 40 MPa or lower (required value), an elastic modulus of the rubber elastic body of 3 MPa to 20 MPa (required value), and a difference in elastic modulus between the surface treatment layer and the rubber elastic body of 1 MPa or more (required value). All the cleaning blades of Examples 1 to 11 exhibited excellent chipping resistance, filming suppression, and cleaning performance. In contrast, the cleaning blades of Comparative Examples 1 and 2, which exhibited an elastic modulus of the surface treatment layer higher than 40 MPa, and the cleaning blades of Comparative Examples 3 and 4, which exhibited an elastic modulus of the rubber elastic body smaller than 3 MPa, were all evaluated as poor (X) in cleaning performance. Also, the cleaning blades of Comparative Examples 5 and 6 had not undergone any surface treatment, and the cleaning blades of Comparative Examples 7 and 8 exhibited a difference in elastic modulus between the surface treatment layer and the rubber elastic body lower than 1 MPa. Thus, these comparative products were evaluated in terms of chipping resistance of "Δ" and filming suppression performance of "X." As a result, through controlling the elastic modulus of the surface treatment layer, the elastic modulus of the rubber elastic body, and the difference in elastic modulus therebetween to fall within specific ranges (Examples 1 to 11), all of excellent chipping resistance, filming suppression, and enhancement in cleaning performance can be attained.

TABLE 1

| | Required range | Ex. 1 | Ex. 2 | Ex. 3 | Ex. 4 | Ex. 5 | Ex. 6 | Ex. 7 | Ex. 8 | Ex. 9 | Ex. 10 | Ex. 11 |
|---|---|---|---|---|---|---|---|---|---|---|---|---|
| Elastic modulus of surface treatment layer | ≤40 MPa | 11.4 | 18.5 | 18.8 | 28.5 | 23.1 | 23.9 | 16.3 | 8.7 | 15.6 | 10.9 | 15.3 |
| Elastic modulus of rubber elastic body | 3 to 20 MPa | 9.8 | 15.4 | 9.8 | 9.8 | 4.8 | 9.8 | 14.3 | 4.8 | 14.3 | 9.8 | 14.3 |
| Difference in elastic modulus between surface treatment layer and rubber elastic body | ≥1 MPa | 1.6 | 3.1 | 9.0 | 18.7 | 18.3 | 14.1 | 2.0 | 3.9 | 1.3 | 1.1 | 1.0 |
| Thickness of surface treatment layer | 10 to 50 μm | 30 | 30 | 30 | 30 | 30 | 30 | 30 | 30 | 30 | 30 | 30 |
| Dynamic friction coefficient | 1.0 to 2.5 | 1.3 | 1.1 | 1.2 | 1.1 | 1.1 | 1.3 | 1.4 | 1.2 | 1.6 | 1.8 | 1.6 |
| Chipping resistance | | ○ | ○ | ○ | ○ | ○ | ○ | ○ | ○ | ○ | ○ | ○ |
| Filming suppression | | ○ | ○ | ○ | ○ | ○ | ○ | ○ | ○ | ○ | ○ | ○ |
| Cleaning performance | | ○ | ○ | ○ | ○ | ○ | ○ | ○ | ○ | ○ | ○ | ○ |

| | Required range | Comp. 1 | Comp. 2 | Comp. 3 | Comp. 4 | Comp. 5 | Comp. 6 | Comp. 7 | Comp. 8 |
|---|---|---|---|---|---|---|---|---|---|
| Elastic modulus of surface treatment layer | ≤40 MPa | 40.2 | 43.1 | 22.6 | 14.5 | 9.8 | 14.3 | 14.9 | 10.7 |
| Elastic modulus of rubber elastic body | 3 to 20 MPa | 9.8 | 9.8 | 2.8 | 2.8 | 9.8 | 14.3 | 14.3 | 9.8 |
| Difference in elastic modulus between surface treatment layer and rubber elastic body | ≥1 MPa | 30.4 | 33.3 | 19.8 | 11.7 | 0.0 | 0.0 | 0.6 | 0.9 |
| Thickness of surface treatment layer | 10 to 50 μm | 30 | 30 | 30 | 30 | 0 | 0 | 30 | 30 |
| Dynamic friction coefficient | 1.0 to 2.5 | 1.0 | 1.0 | 0.8 | 0.9 | 3.3 | 3.3 | 2.6 | 2.8 |
| Chipping resistance | | ○ | ○ | ○ | ○ | Δ | Δ | Δ | Δ |
| Filming suppression | | ○ | ○ | ○ | ○ | X | X | X | X |
| Cleaning performance | | X | X | X | X | ○ | ○ | ○ | ○ |

Next, cleaning blades each provided with a surface treatment layer having a thickness differing from the above value were produced through the following procedure, to thereby provide cleaning blades of Examples 12 to 18.

Example 12

A rubber elastic body was produced through the same procedure as employed in Example 7. The thus-obtained rubber elastic body was found to have an elastic modulus of 14.3 MPa. The rubber elastic body was subjected to a surface treatment in a manner similar to that of Example 3, except that the surface treatment liquid immersion time was changed, to thereby produce a cleaning blade having a surface treatment layer with an elastic modulus of 16.3 MPa and a thickness of 10 μm. The cleaning blade was found to have a difference in elastic modulus between the surface treatment layer and the rubber elastic body of 2.0 MPa, and the surface treatment layer was found to have a dynamic friction coefficient of 1.2.

Example 13

A rubber elastic body was produced through the same procedure as employed in Example 7. The thus-obtained rubber elastic body was found to have an elastic modulus of 14.3 MPa. The rubber elastic body was subjected to a surface treatment in a manner similar to that of Example 3, except that the surface treatment liquid immersion time and the time of heating by an oven were changed, to thereby produce a cleaning blade having a surface treatment layer with an elastic modulus of 16.2 MPa and a thickness of 20 μm. The cleaning blade was found to have a difference in elastic modulus between the surface treatment layer and the rubber elastic body of 1.9 MPa, and the surface treatment layer was found to have a dynamic friction coefficient of 1.2.

Example 14

A rubber elastic body was produced through the same procedure as employed in Example 7. The thus-obtained rubber elastic body was found to have an elastic modulus of 14.3 MPa. The rubber elastic body was subjected to a surface treatment in a manner similar to that of Example 3, except that the surface treatment liquid immersion time and the time of heating by an oven were changed, to thereby produce a cleaning blade having a surface treatment layer with an elastic modulus of 16.4 MPa and a thickness of 30 μm. The cleaning blade was found to have a difference in elastic modulus between the surface treatment layer and the rubber elastic body of 2.1 MPa, and the surface treatment layer was found to have a dynamic friction coefficient of 1.2.

Example 15

A rubber elastic body was produced through the same procedure as employed in Example 7. The thus-obtained rubber elastic body was found to have an elastic modulus of 14.3 MPa. The rubber elastic body was subjected to a surface treatment in a manner similar to that of Example 3, except that the surface treatment liquid immersion time and the time of heating by an oven were changed, to thereby produce a cleaning blade having a surface treatment layer with an elastic modulus of 16.3 MPa and a thickness of 40 μm. The cleaning blade was found to have a difference in elastic modulus between the surface treatment layer and the rubber elastic body of 2.0 MPa, and the surface treatment layer was found to have a dynamic friction coefficient of 1.2.

Example 16

A rubber elastic body was produced through the same procedure as employed in Example 7. The thus-obtained rubber elastic body was found to have an elastic modulus of 14.3 MPa. The rubber elastic body was subjected to a surface treatment in a manner similar to that of Example 3, except that the surface treatment liquid immersion time and the time of heating by an oven were changed, to thereby produce a cleaning blade having a surface treatment layer with an elastic modulus of 16.4 MPa and a thickness of 50 μm. The cleaning blade was found to have a difference in elastic modulus between the surface treatment layer and the rubber elastic body of 2.1 MPa, and the surface treatment layer was found to have a dynamic friction coefficient of 1.3.

Example 17

A rubber elastic body was produced through the same procedure as employed in Example 7. The thus-obtained rubber elastic body was found to have an elastic modulus of 14.3 MPa. The rubber elastic body was subjected to a surface treatment in a manner similar to that of Example 3, except that the surface treatment liquid immersion time and the time of heating by an oven were changed, to thereby produce a cleaning blade having a surface treatment layer with an elastic modulus of 16.5 MPa and a thickness of 5 μm. The cleaning blade was found to have a difference in elastic modulus between the surface treatment layer and the rubber elastic body of 2.2 MPa, and the surface treatment layer was found to have a dynamic friction coefficient of 1.2.

Example 18

A rubber elastic body was produced through the same procedure as employed in Example 7. The thus-obtained rubber elastic body was found to have an elastic modulus of 14.3 MPa. The rubber elastic body was subjected to a surface treatment in a manner similar to that of Example 3, except that the surface treatment liquid immersion time and the time of heating by an oven were changed, to thereby produce a cleaning blade having a surface treatment layer with an elastic modulus of 16.5 MPa and a thickness of 55 μm. The cleaning blade was found to have a difference in elastic modulus between the surface treatment layer and the rubber elastic body of 2.2 MPa, and the surface treatment layer was found to have a dynamic friction coefficient of 1.1.

Test Example 2

<Surface Treatment Layer Thickness>

Each of the cleaning blades of Examples 12 to 18 was assessed in terms of chipping resistance, filming suppression, and cleaning performance. Table 2 shows the results.

The above evaluation was performed by means of an apparatus TASKalfa5550ci (product of KYOCERA Corporation).

As shown in Table 2, the cleaning blades of Examples 12 to 18, having a surface treatment layer elastic modulus of 40 MPa or less (falling within a required range), a rubber elastic body elastic modulus of 5 to 20 MPa (falling within a required range), and a difference in elastic modulus of the surface treatment layer and the rubber elastic body of 1 MPa or more (falling within a required range) were evaluated as a rating "○" or "Δ" in terms of chipping resistance, filming suppression, and cleaning performance. Among them, the cleaning blades of Examples 12 to 16, having a surface treatment layer thickness of 10 μm to 50 μm (falling within a required range) were all evaluated as a rating "○" in terms of chipping resistance, filming suppression, and cleaning performance. In contrast, the cleaning blade of Example 17, having a surface treatment layer thickness less than 10 μm, was evaluated as a rating "Δ" in terms of chipping resistance and filming suppression. The cleaning blade of Example 18, having a surface treatment layer thickness more than 50 μm, was evaluated as a rating "Δ" in terms of chipping resistance and cleaning performance. Therefore, chipping resistance, filming suppression, and cleaning performance were found to be further improved by controlling the elastic modulus of the surface treatment layer, that of the rubber elastic body, and the difference in elastic modulus therebetween to fall within specific ranges, respectively, and by controlling the surface treatment layer to 10 to 50 μm.

The invention claimed is:

1. A cleaning blade, comprising:

an elastic body formed of a rubber base material molded product; and a surface treatment layer on at least an area of the elastic body to be brought into contact with a cleaning object, wherein:

the surface treatment layer is formed by impregnating a surface portion of the elastic body with a surface treatment liquid containing an isocyanate compound and an organic solvent, and hardening the liquid;

the surface treatment layer has an indentation elastic modulus determined according to ISO 14577 of 40 MPa or lower;

the elastic body has an indentation elastic modulus determined according to ISO 14577 of 3 MPa to 20 MPa; and the difference in indentation elastic modulus between the surface treatment layer and the elastic body is 1 MPa or more;

wherein the indentation elastic modulus was measured through a load-unload test by means of Dynamic Ultra Micro Hardness Tester under the following conditions: retention time (5 s), maximum test load (0.98 N), loading speed (0.14 mN/s), and indentation depth (3 μm to 10 μm).

2. The cleaning blade according to claim 1, wherein the surface treatment layer has a thickness of 10 μm to 50 μm.

3. The cleaning blade according to claim 1, wherein a difference between elastic modulus between the surface treatment layer and the elastic body is 1 MPa or more.

TABLE 2

| | Required range | Ex. 12 | Ex. 13 | Ex. 14 | Ex. 15 | Ex. 16 | Ex. 17 | Ex. 18 |
|---|---|---|---|---|---|---|---|---|
| Elastic modulus of surface treatment layer | ≤40 MPa | 16.3 | 16.2 | 16.4 | 16.3 | 16.4 | 16.5 | 16.5 |
| Elastic modulus of rubber elastic body | 3 to 20 MPa | 14.3 | 14.3 | 14.3 | 14.3 | 14.3 | 14.3 | 14.3 |
| Difference in elastic modulus between surface treatment layer and rubber elastic body | ≥1 MPa | 2.0 | 1.9 | 2.1 | 2.0 | 2.1 | 2.2 | 2.2 |
| Thickness of surface treatment layer | 10 to 50 μm | 10 | 20 | 30 | 40 | 50 | 5 | 55 |
| Dynamic friction coefficient | 1.0 to 2.5 | 1.2 | 1.2 | 1.2 | 1.2 | 1.3 | 1.2 | 1.1 |
| Chipping resistance | | ○ | ○ | ○ | ○ | ○ | Δ | Δ |
| Filming suppression | | ○ | ○ | ○ | ○ | ○ | Δ | ○ |
| Cleaning performance | | ○ | ○ | ○ | ○ | ○ | ○ | Δ |

INDUSTRIAL APPLICABILITY

The cleaning blade of the present invention is suited for a cleaning blade employed in image-forming apparatuses such as an electrophotographic copying machine or printer, and a toner-jet-type copying machine or printer. The cleaning blade of the present invention may find other uses, such as various blades and cleaning rollers.

BRIEF DESCRIPTION OF THE DRAWINGS

1 cleaning blade
10 blade main body
11 elastic body
12 surface treatment layer
20 supporting member

4. The cleaning blade according to claim 1, wherein the surface treatment layer has a dynamic friction coefficient of 1.0 to 2.5 determined according to ISO 8295.

5. The cleaning blade according to claim 1, wherein the isocyanate compound is selected from the group consisting of tolylene diisocyanate, 4,4'-diphenylmethane diisocyanate, p-phenylene diisocyanate, naphthalene diisocyanate 3,3'-dimethylbiphenyl-4, 4'-diyl diisocyanate, xylene diisocyanate, lysine diisocyanate methyl ester, and dimethyl diisocyanate.

6. The cleaning blade according to claim 1, wherein the elastic body is formed from polyurethane and the isocyante compound is 4,4'-diphenylmethane diisocyanate or 3,3'-dimethylbiphenyl-4, 4'-diyl diisocyanate.

* * * * *